US006651819B2

(12) United States Patent
Burnett et al.

(10) Patent No.: US 6,651,819 B2
(45) Date of Patent: Nov. 25, 2003

(54) DEBRIS REMOVAL FROM FLUIDIZED SAND BED

(75) Inventors: Rick Allen Burnett, Jamestown, OH (US); Bradley Howard Foreman, Waynesville, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/902,376

(22) Filed: Jul. 6, 2001

(65) Prior Publication Data

US 2003/0006172 A1 Jan. 9, 2003

(51) Int. Cl.[7] ..... B07B 1/28; B07B 1/42

(52) U.S. Cl. ..... 209/252; 209/235; 209/362; 209/369; 164/5

(58) Field of Search ..... 209/252, 369, 209/350, 362, 250, 235; 164/5, 131, 132

(56) References Cited

U.S. PATENT DOCUMENTS

| | | | | | |
|---|---|---|---|---|---|
| 1,659,557 | A | * | 2/1928 | Adelmann | 209/409 |
| 1,823,671 | A | * | 9/1931 | Thode | 164/130 |
| 1,860,022 | A | * | 5/1932 | Eggert | 164/157 |
| 3,771,971 | A | * | 11/1973 | Capes et al. | 23/313 R |
| 4,071,304 | A | * | 1/1978 | Chauvin et al. | 427/185 |
| 4,337,782 | A | | 7/1982 | DaSilva | 130/30 |
| 4,425,144 | A | * | 1/1984 | Casperson | 95/276 |
| 4,828,006 | A | * | 5/1989 | Vander Jagt | 164/34 |
| 4,880,530 | A | * | 11/1989 | Frey | 209/380 |
| 4,955,425 | A | * | 9/1990 | McKenna | 164/269 |
| 4,958,443 | A | * | 9/1990 | Haueter et al. | 34/593 |
| 5,048,464 | A | | 9/1991 | Shirley | 119/166 |
| 5,119,535 | A | * | 6/1992 | Gnagy et al. | 29/469.5 |
| 5,350,160 | A | * | 9/1994 | Crafton et al. | 266/252 |
| 5,392,922 | A | * | 2/1995 | Chen | 209/20 |
| 5,423,370 | A | * | 6/1995 | Bonnemasou et al. | 164/132 |
| 5,544,620 | A | | 8/1996 | Sarkissian | 119/166 |
| 6,253,830 | B1 | * | 7/2001 | Bickford et al. | 164/132 |
| 6,286,459 | B1 | | 9/2001 | Parr | 119/166 |
| 2003/0079851 | A1 | * | 5/2003 | Jo | 164/5 |

* cited by examiner

*Primary Examiner*—Donald P. Walsh
*Assistant Examiner*—Daniel K Schlak
(74) *Attorney, Agent, or Firm*—VG Ramaswamy; Hasse Guttag & Nesbitt LLC; Eric W. Guttag

(57) ABSTRACT

Apparatus for removing debris from a fluidized sand bed. One or more troughs extend radially from a vertical shaft. Associated with each trough is a perforated chute. The apparatus is placed into the fluidized bed of sand, and rotated. As the apparatus rotates, the perforated chute sifts, or separates, debris from the fluidized sand. That is, the fluidized sand flows through the perforations, but the debris does not. When the apparatus is removed from the fluidized bed, the debris tumbles down the chute, into the troughs, if it has not already done so, and is captured.

5 Claims, 11 Drawing Sheets

DEBRIS REMOVAL FROM FLUIDIZED SAND BED

TECHNICAL FIELD

The invention relates to removal of stray debris from fluidized sand beds. The beds are used in fabrication of molds used in metal casting. The debris, if not removed, can damage the patterns from which the molds are being made.

BACKGROUND OF THE INVENTION

In the metal casting art, metal is poured into a mold. The mold is generally constructed of a high melting-point ceramic material. In the process of making the mold, a wax replica, or pattern, of the actual item to be cast is first made. Object 3 in FIG. 1 represents the pattern. The pattern 3 is dipped into a liquid ceramic slurry 6, contained in tank 9. Conceptually, the slurry 6 can be viewed as a thin liquid plaster.

Next, the pattern is removed from the slurry 6, and, while still wet with a coating of the slurry, inserted into a fluidized bed 12 of sand, in tank 14. The sand is fluidized by jets of compressed air (not shown) or other gas, which agitate the sand and cause the sand particles to become suspended in the tank 14.

A problem arises at this point, because debris tends to get deposited into the fluidized bed. This debris is set into motion by the fluidized sand 12, and the moving debris can collide with the pattern 3 and knock off parts of the pattern 3, thereby creating even more debris. For example, as shown in FIG. 2, a section 15 of the pattern 3 is shown as being broken off, and now contained in the fluidized bed 12. Prior to breakage, section 15 formed phantom part 16 of the pattern 3.

In the prior art, the debris was typically removed by persons who, in essence, sifted the debris out of the sand, using sieves or screens. However, this process was unable to remove all debris. One reason is that the tanks 14 are deep and wide, compared with the size of the sieves and screens used. Also, the presence of the fluidized sand reduces visibility, so that the debris-removal operation involves a somewhat random sifting process of various areas of the tanks.

In addition, if larger sieves or screens were to be used to mitigate the problem just stated, the larger sieves and screens represented larger weights which the persons must manipulate and lift. In industry, requiring personnel to lift large weights is not favored, because of possible injury to the persons performing the lifting.

The Inventors have developed a system for more effectively cleaning the tank 14 which contains the fluidized bed of sand.

SUMMARY OF THE INVENTION

In one form of the invention, a helical screen is dipped into the fluidized bed, and then rotated. Fluidized sand flows through the screen, but debris does not, and is captured.

DETAILED DESCRIPTION OF THE INVENTION

Figure 5:
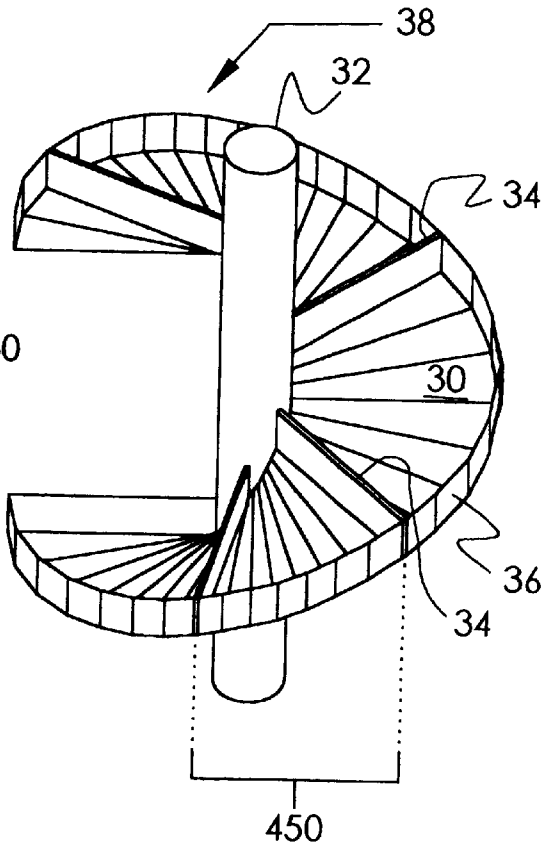
FIGS. 3, 4, and 5 illustrate a progressive assembly of one form of the invention, which is shown in FIG. 5.
Figure 3:
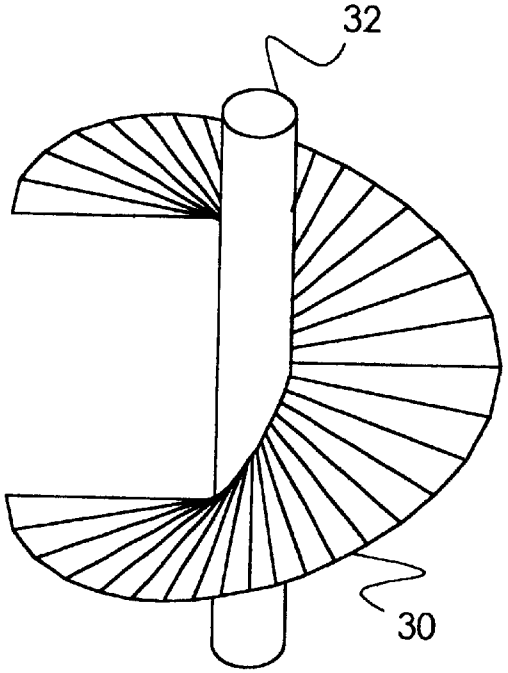

FIG. 5 illustrates one form of the invention, and the structure shown in FIG. 5 will be explained by reference to FIGS. 3 and 4. FIG. 3 illustrates a helical screen 30, which is supported by a shaft 32.

Figure 4:
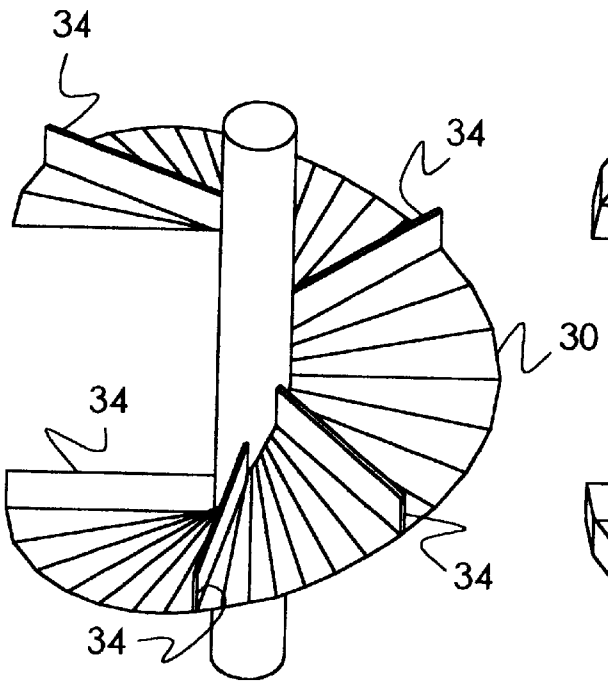

FIG. 4 illustrates walls, or dams, 34, which are placed onto the helical screen 30. The walls 34 extend radially from shaft 32. FIG. 5 illustrates a helical outer wall 36, which is attached to the outer edge of the screen 30, and the overall structure forms an auger 38. The mechanisms by which the auger 38 operates will first be explained by an analogy to a two-dimensional inclined ramp, for simplicity.

Figure 6:
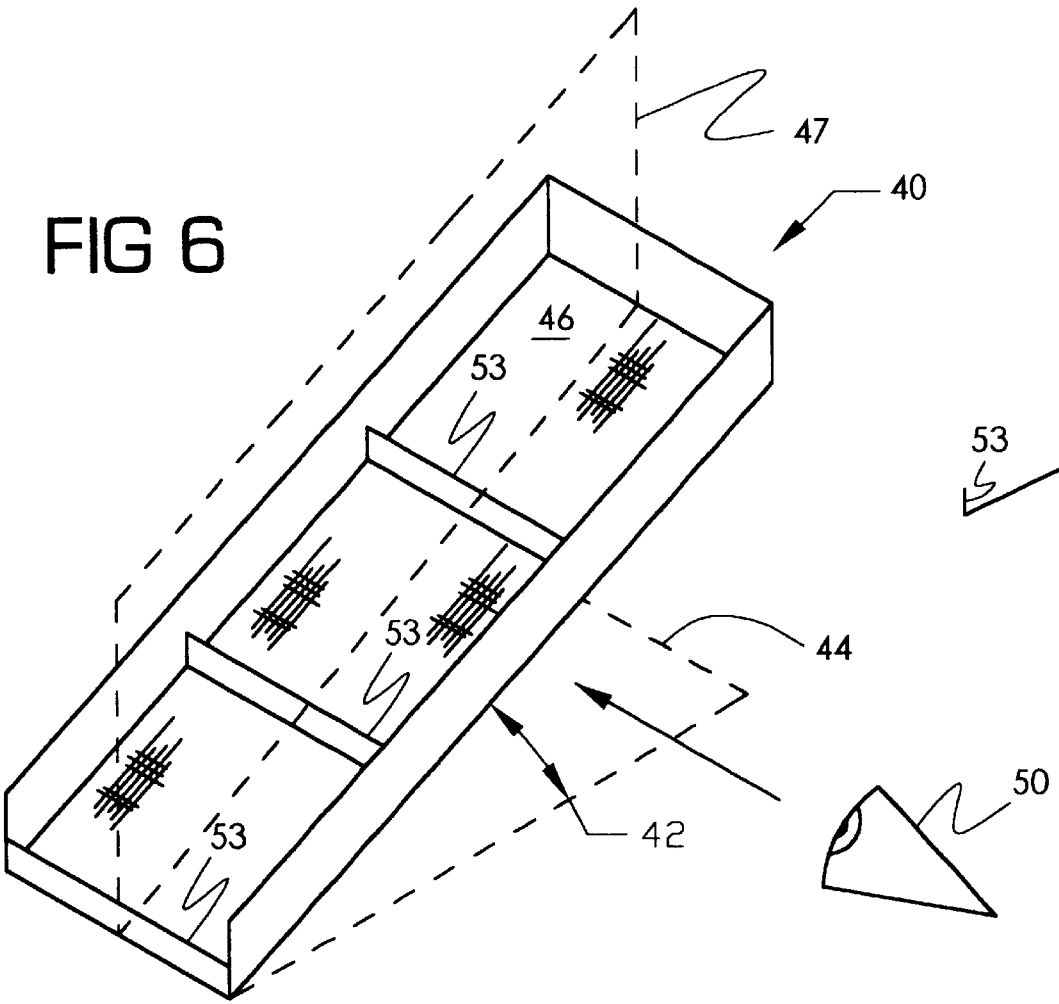
FIG. 6 is a perspective view of one form of the invention.

FIG. 6 illustrates the ramp 40, which is inclined, as indicated by angle 42 which ramp 40 makes with the horizontal, represented by plane 44. A screen 46 forms the bottom, or deck, of the ramp 40, and corresponds to screen 30 in FIGS. 3–5.

Figure 7:
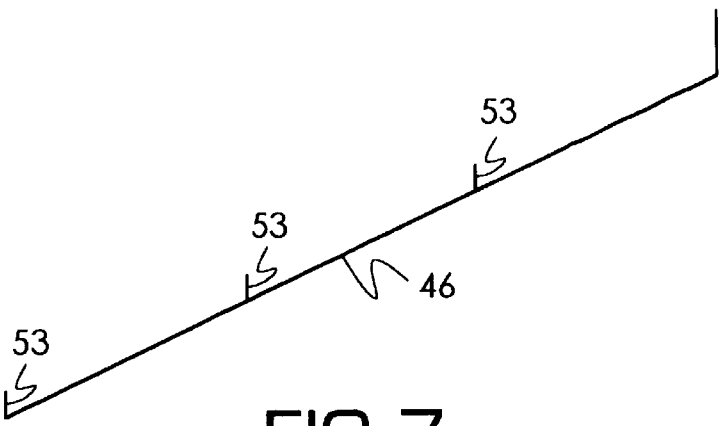
FIG. 7 is a simplified cross-sectional view of FIG. 6, taken across section 47, as seen by eye 50.

The screen 46 of FIG. 6 is also shown in FIG. 7, which is a cross-sectional view taken at plane 47 in FIG. 6, as viewed by eye 51. Upstanding barriers 53 serve to catch debris, in a manner to be later described, and correspond to walls 34 in FIGS. 4 and 5.

A simplified example of one mode of operation of the apparatus of FIG. 6 will be given. FIGS. 8–11 represent a sequence of events, wherein the ramp 40 of FIG. 5 moves through a sand cloud 70 carrying debris items 73 and 74. Sand cloud 70 represents a region of the fluidized bed 12 of FIG. 1. In FIGS. 8–11, the ramp 40 moves to the left or, equivalently, the sand cloud 70 moves to the right.

Figure 8:
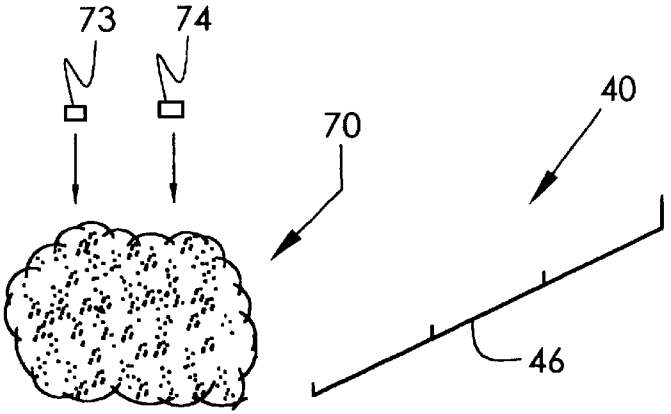
FIGS. 8, 9, 10, and 11 illustrate passage of the structure 40 of FIGS. 6 and 7 through a sand cloud 70. Sand cloud 70 represents the fluidized bed 12 in FIG. 1.
Figure 9:
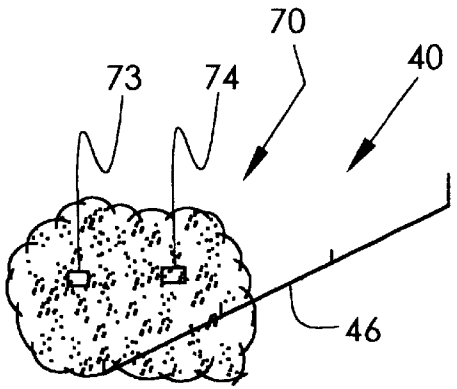
Figure 10:
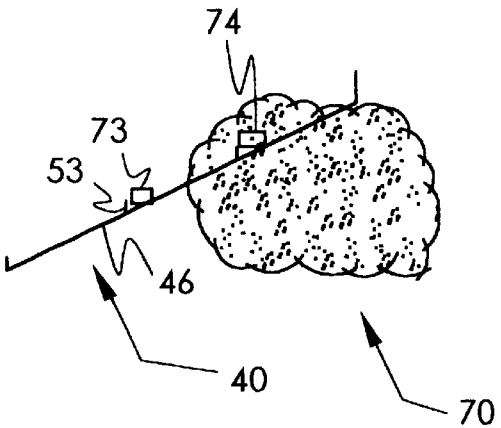
Figure 11:
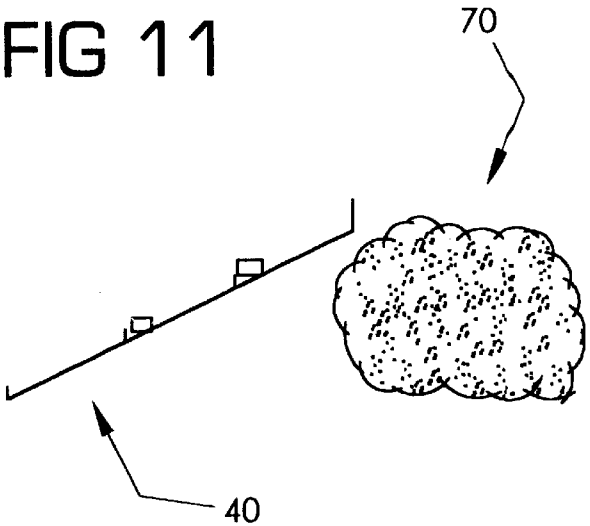

In FIG. 8, the ramp 40 approaches the sand cloud 70. In FIG. 9, the ramp 40 enters the sand cloud 70. In FIG. 10, the debris items 73 and 74 are captured by the combined action of the screen 46 and the barriers 53. In FIG. 11, the ramp 40 has exited the sand cloud 70, after extracting, or filtering, the debris items 73 and 74 from the cloud 70.

Therefore, as so far described, one form of the invention moves the ramp 40 of FIG. 6 through a fluidized bed of sand, represented by sand cloud 70 in FIGS. 8–11, to thereby extract debris.

Figure 12:
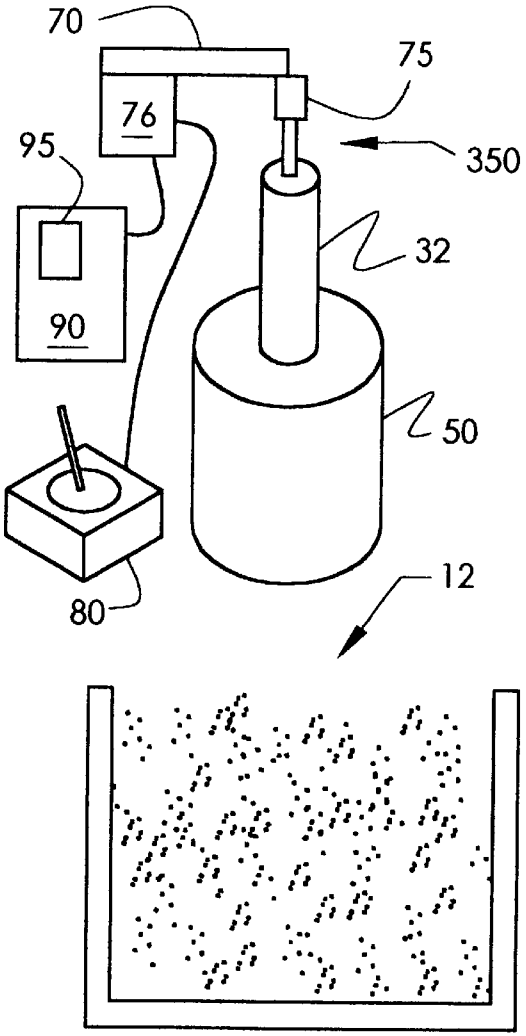
FIGS. 12, 13, and 14 illustrate a sequence of events occurring in one form of the invention.
Figure 13:
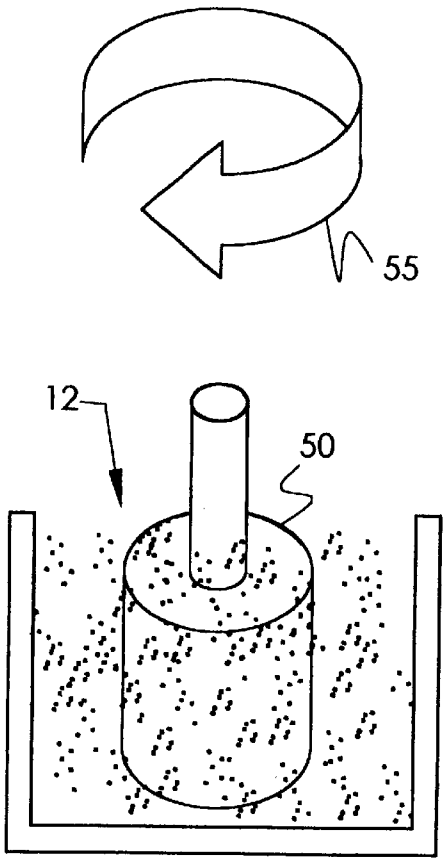
Figure 14:
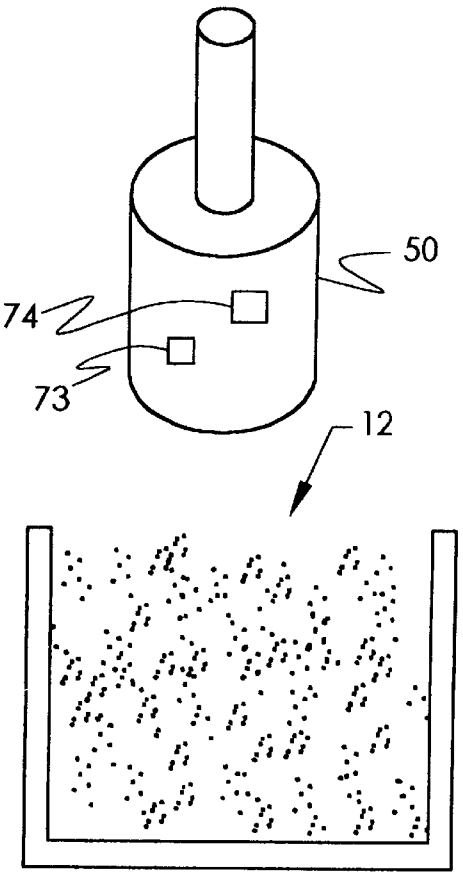

In another form of the invention, the auger 38 of FIG. 5 is used for the extraction. As shown in FIGS. 12–14, the auger 38, represented by cylinder 50, is placed above the fluidized bed, as in FIG. 12. Auger 50 is then inserted into the fluidized bed 12, as indicated in FIG. 13. The auger 50 is rotated while within the fluidized bed 12, as indicated by arrow 55.

The rotation causes the relative motion between the screen 46 in the auger of FIG. 5 and the sand within the fluidized bed of FIG. 13. That is, the rotation in FIG. 13 causes the auger 50 to experience a similar motion to that of the flat screen 46 shown in FIGS. 8–11.

In FIG. 14, the auger 50 is withdrawn from the fluidized bed 12, carrying debris items 73 and 74.

The auger 50 is carried by a gantry 71, or robotic arm, shown in simplified form in FIG. 12. Such arms are known in the art. A motor 75 rotates the auger 50. The gantry can be controlled by an operator (not shown) who controls the position of the gantry 71, and thus the position of the auger 50, by means of a joystick control 80, or equivalent control.

Significantly, in one form of the invention, the auger 50 is not moved, nor is it rotated, by human muscle power. Instead, motor 75 performs the rotation, gantry 71 supports the weight of the auger 50, and block 76 represents mechanisms which move the gantry 71 to various positions.

The Inventors point out that a small amount of human muscle power may be involved in operating the joystick 80 of FIG. 12. However, that muscle power provides no energy for lifting or moving the auger 50. That muscle power only provides control inputs for other apparatus which move the auger 50.

Alternately, the gantry 71 can be computer-controlled. For example, the gantry 71 can comprise an X-Y-Z table, known in the art, which can position the auger 50 at any selected position. A computer, or other controller, 90 runs one, or more, programs 95 which control the position of the gantry 71. In this mode of operation, the operator merely launches the program, and the computer cycles the gantry 71 through an appropriate cleaning cycle, which would include the steps shown in FIGS. 12–14, and perhaps additional steps.

Figure 16:
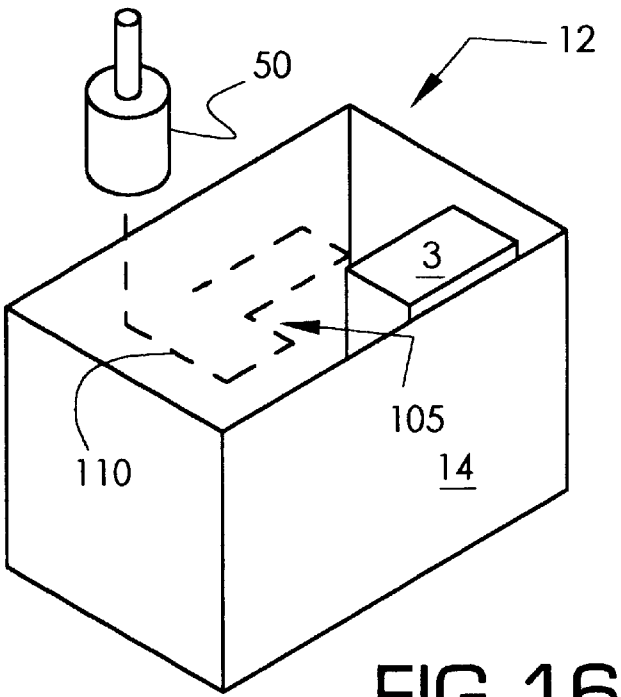
FIGS. 15, 16, and 17 illustrate two different modes of operation of one form of the invention.
Figure 17:
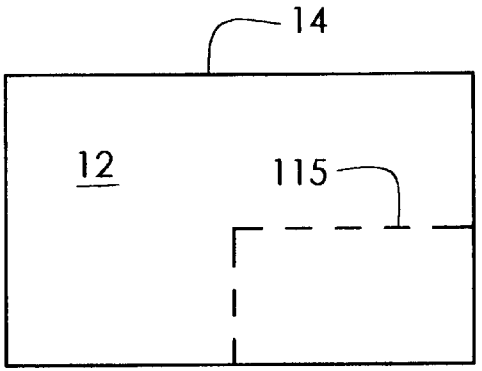
Figure 15:
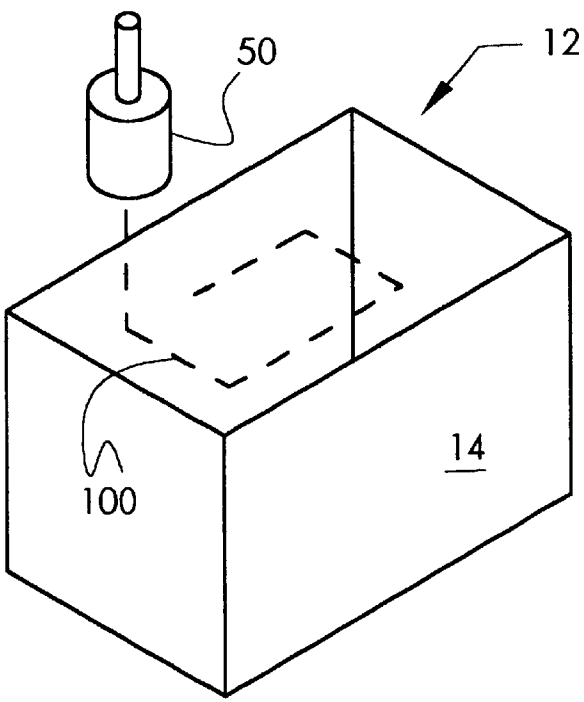

FIGS. 15–17 illustrate two types of additional steps, or cycles. In FIG. 15, the gantry (not shown) inserts the auger 50 into the fluidized bed 12, and carries the auger 50 along the path 100 shown, and then withdraws the auger 50. In the general case, the auger is carried, while rotating, through all regions of the fluidized bed, while the sand is kept fluidized.

It is contemplated that the auger 50 may cover the same parts of the tank more than once. For larger tanks, the auger 50 may take a raster-type pattern, or move along a tightening spiral into a center, and then spiral back out. Other paths are possible.

It is also contemplated that the debris-removal process may coincide with the deposition of the ceramic slurry described in connection with FIG. 1. For example, FIG. 16 illustrates a mold-pattern 3 present within the fluidized bed 12. The computer driving the gantry 71 is programmed to avoid the zone allotted to the pattern 3, as indicated by the jog 105 in path 110, which avoids the pattern 3. FIG. 17 illustrates a top view of the tank 14 which contains fluidized bed 12, and shows a representative zone 105 which the auger 15 is prohibited from entering.

Therefore, as just described, two types of programs 95 in FIG. 12, or two modes, are available. In one type, it is presumed that the tank 14 is empty of patterns 3, and that the auger 50 can be moved anywhere in the tank 14 at will. In the second mode, different regions of the tank are restricted, and allocated to patterns 3. Region 115 in FIG. 17 provides an example. The auger 50 is forbidden to enter those regions, when they are active.

A few specific details about the mechanism by which the auger 50 picks up debris will be discussed. This discussion applies directly to the ramp 40 of FIG. 6, and its principles also apply to the auger 38 of FIG. 5.

Figure 18:
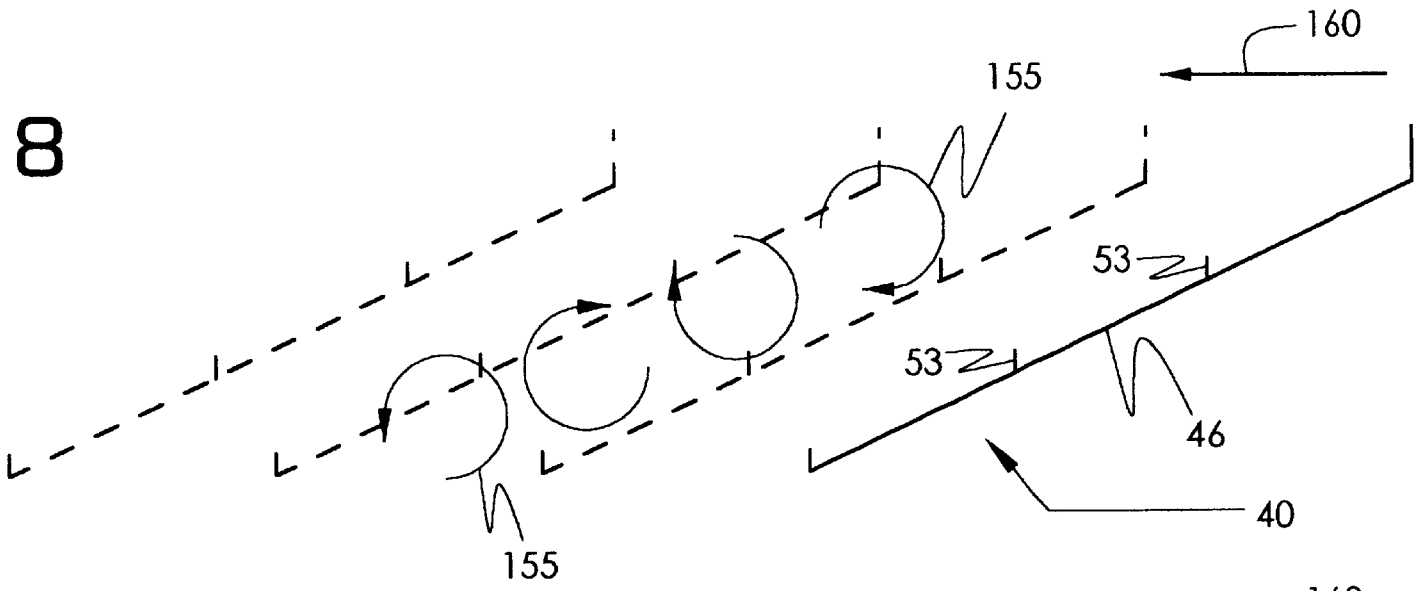
FIGS. 18, 19, 20, and 21 illustrate a mechanism by which one form of the invention operates.

FIG. 18 illustrates four successive positions of the screen 46 of FIG. 4. Circles 155 represent the random paths of the sand particles in the fluidized bed 12 of FIG. 1.

As the screen 46 in FIG. 18 moves in the direction of arrow 160, it moves through the moving sand particles 155. The paths of the sand particles will be somewhat disturbed by the presence of the ramp 40, in the sense that the holes (not shown) in the screen 46 behave, to a certain extent, like very short corridors. The hole-corridors will slightly re-direct the paths of the sand particles.

However, that re-direction, in general, will be small. Further, after this small amount of re-direction, the sand particles will immediately collide with other sand particles, and become randomized again.

Therefore, the passage of the screen 46 through the fluidized sand is not seen as changing the random motion of the sand, although conservation-of-energy principles would indicate that the velocity of the sand particles may be slightly reduced because of the collisions with the ramp 40. Nevertheless, it will be assumed that, as the ramp 40 moves through the moving sand particles 155, the sand particles remain almost completely undisturbed by the ramp 40.

Figure 19:
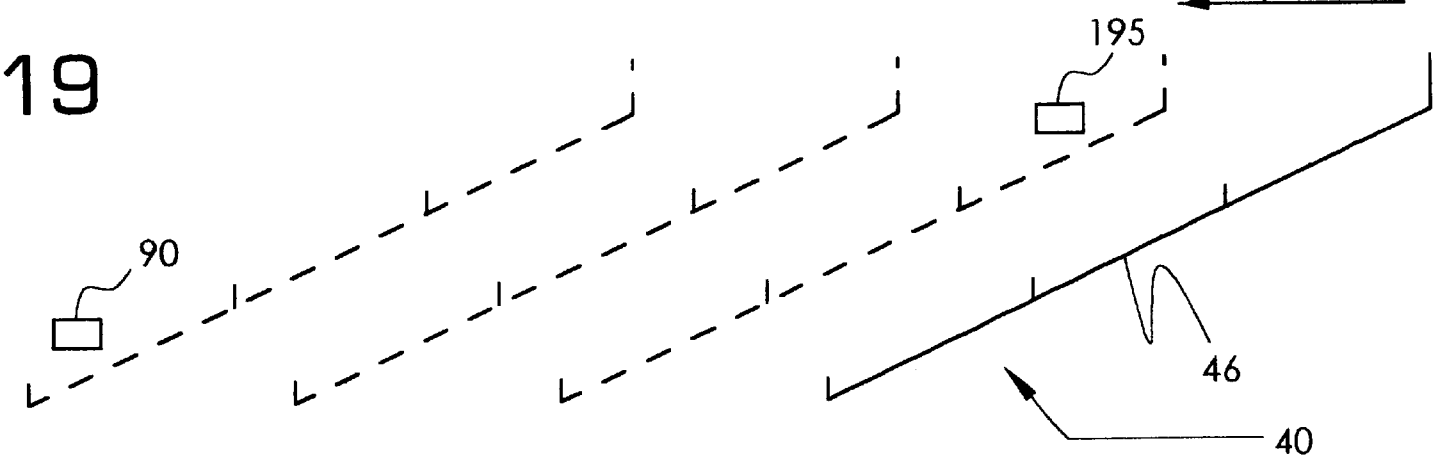

The debris within the sand is also not disturbed, in a specific sense. For example, the screen 46, even though inclined, does not behave as a ramp, or inclined plane, with respect to the debris. For example, as shown in FIG. 19, if the ramp 40 encounters a debris item 190 during the ramp's travel, the leftward motion of the screen 46 does not cause the particle 190 to move up the ramp, and occupy a final position indicated by block 195. Restated, the situation of FIG. 19 does not, in general, occur: debris item 90 does not climb the ramp and attain the final position of block 195.

Figure 20:
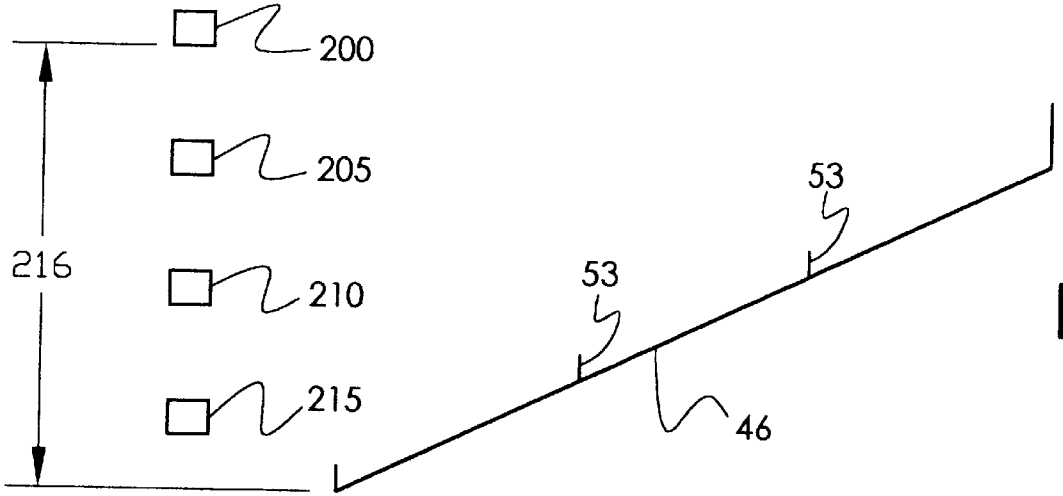
Figure 21:
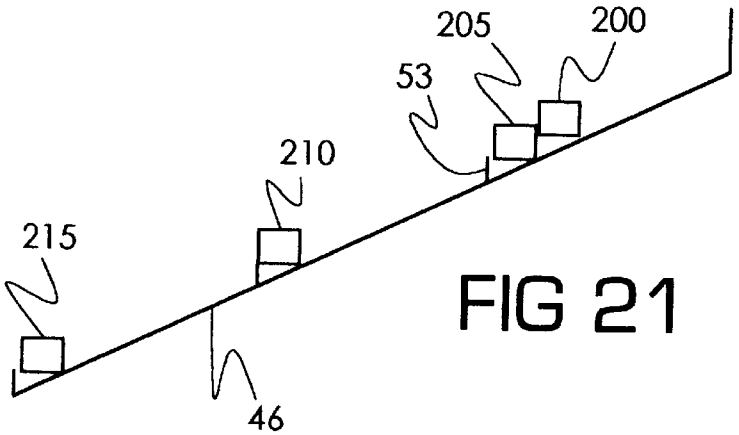

Instead, the debris particles behave as shown in FIGS. 20 and 21. Assume that four debris particles 200, 205, 210, and 215 are suspended in the fluidized bed, not shown. As screen 46 moves to the left, it will collect the particles, and their final positions will resemble those indicated in FIG. 21. Significantly, the particles will not be positioned as indicated in FIG. 22.

Restated, either (1) the particles 200, 205, 210, and 215 will remain at their same heights, with one height being indicated by arrow 216 in FIG. 20, or (2) they may fall to a lower height, and be held there by one of the walls 53. Particles 200 and 205 represent the latter case. But the particles will not, in general, climb the screen 46, and be collected at a greater height, as FIG. 22 would indicate.

The principle just described applies to particles of the size of ½ inch in diameter, and having a solid wax core. However, exceptions to the principle just stated can occur. For example, very small particles, especially if very light, can be buoyed up by the fluidized sand. For example, table tennis balls may climb the ramp. However, such particles will inflict only minor damage of the type described in the Background of the Invention, and may not need to be extracted from the fluidized bed. Further, such particles are considered unlikely to be found in the fluidized bed 12.

Figure 22:
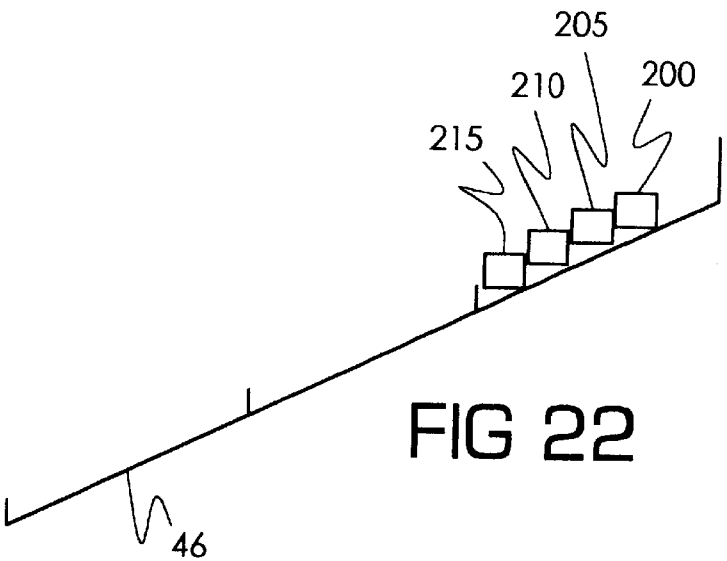
FIG. 22 illustrates a mode of operation which does not commonly occur under the invention.

Therefore, the debris which will be collected will, in general, not climb up the screen 46 as illustrated in FIG. 22.

Figure 23:
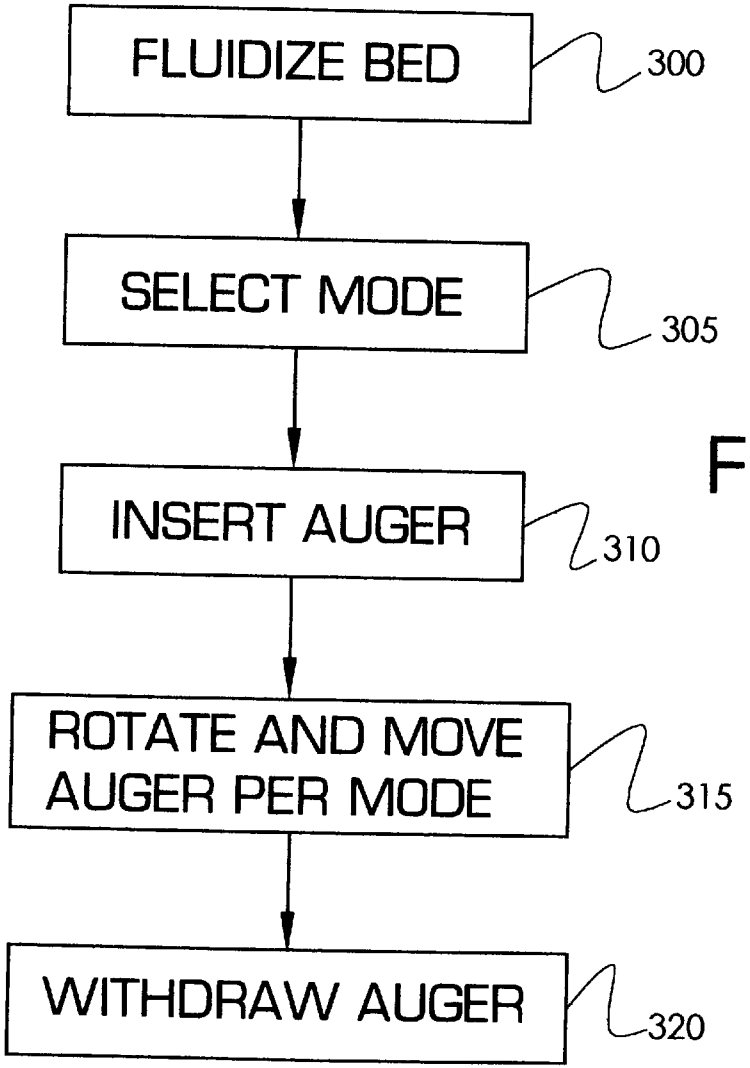
FIG. 23 is a flow chart illustrating a sequence of processes undertaken by one form of the invention.

FIG. 23 illustrates a flow chart of steps undertaken by one form of the invention, and some, or all, of these steps may be implemented by the programs 95 of FIG. 12. In block 300 in FIG. 23, the fluidized bed 12 of FIG. 1 is brought into operation. In block 305, the user selects a mode of operation. For example, the user may select the mode which drives the auger 50 along path 100 in FIG. 15. Alternately, the user may select the mode which utilizes path 110 in FIG. 16, and avoids zone 115 in FIG. 17.

In block 310 in FIG. 23, the mechanism 76 of FIG. 12 moves the gantry 70, so that the auger 50 is inserted into the tank 14, as in FIG. 15. In block 315 in FIG. 23, motor 75 in FIG. 12 rotates the auger 50, and mechanism 76 cause combined rotation of the auger 50 and movement of auger 50 along an appropriate path, such as path 100 in FIG. 15, based on the mode selected in block 305. In block 320 in FIG. 23, the auger 50 is removed from the tank 14.

In one embodiment, the auger 50 in FIG. 12 is separable from the motor 75. That is, the auger 50 remains in a stowed position until needed, while gantry 70 is used for other purposes while the auger 50 is stowed. When the auger 50 is needed, the gantry removes it from stowage, and places the auger 50 into operation.

Various types of connections 350 in FIG. 12 between the motor 75 and shaft 32 can be used. One connection is a simple rigid coupling. Another connection has some of the properties of a universal joint. For example, an actual universal joint can be used, of the type used on the driveshaft of an automobile. One of the properties of a universal joint is that torque is delivered to the shaft 32, but the shaft 32 need not remain coaxial with the shaft, not shown, of the motor 75. That is, shaft 32 can swing like a pendulum.

A connection resembling a universal joint is attained if shaft 32 bears a common eye-type hook, or loop, and motor 75 contains an ordinary lifting hook, which resembles the letter J. When the lifting hook, or J, engages the eye-hook, or loop, the lifting hook can lift the loop, and also apply torque to the loop. But the loop can still wobble about the lifting hook, thereby providing the universal-joint function, at least partially. In addition, the lifting hook is easily removable from the eye-hook, so that the gantry 70 can be used for other purposes.

The auger 38 in FIG. 5 can be constructed in different ways. In FIG. 5, screen 30 is a woven-wire screen, having a mesh suitable for the size of the debris to be collected. Meshes of 1 to 10 wires per inch, which correspond to holes of 1×1 inch to 0.1×0.1 inch, respectively, are contemplated. Alternately, screen 30 can be replaced by sheet metal containing punched holes, or expanded sheet metal, or other equivalents.

In FIG. 5, walls 34 and 36 are solid material, such as sheet metal. They are imperforate, although they can be constructed of screen material, as in FIG. 25, described below.

Figure 24:
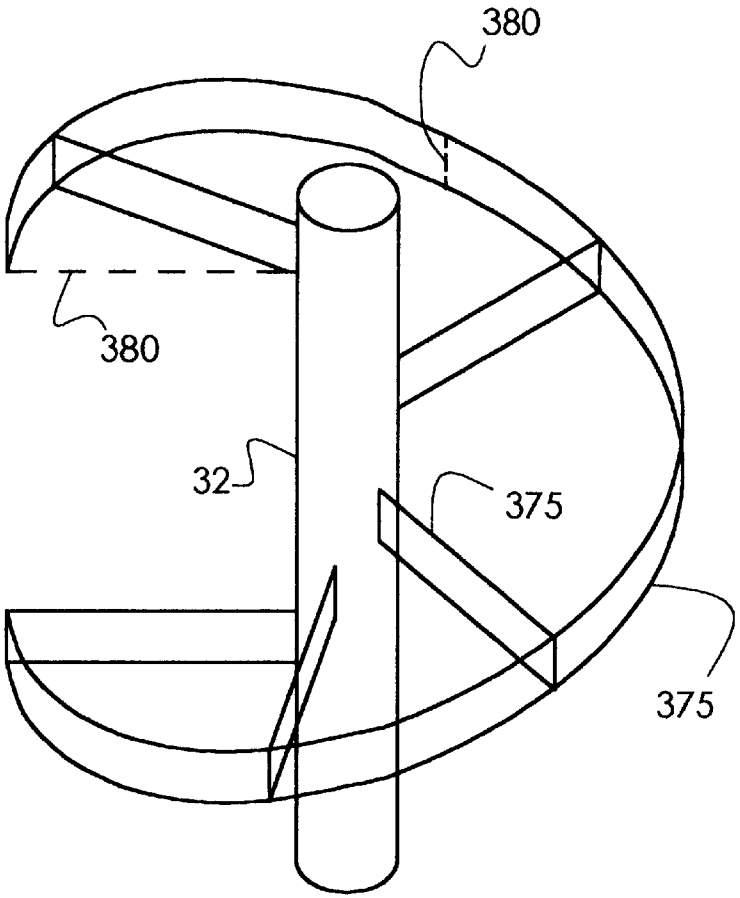

In another embodiment, tubes or rods 375 are welded, or otherwise fastened, into the structure shown in FIG. 24. FIG. 24 shows an open cage: no screens are present. Additional rods or tubes can be added for strength, as indicated by dashed items 380. Then, screening 390 is installed, as in FIG. 25, to form walls 34 and 36, and screen-deck 30.

Figure 28:
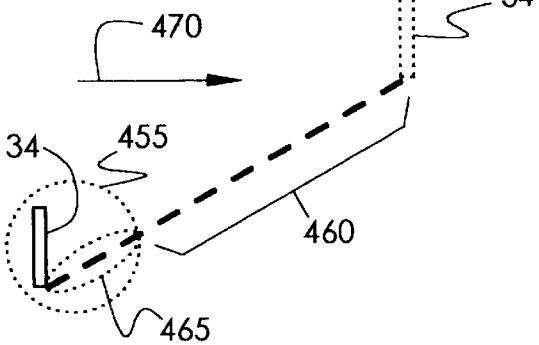
FIG. 28 illustrates section 450 in FIG. 5, in cross-section.

FIG. 28 illustrates a section 450 of FIG. 5, but in cross sectional view. Section 450 can be viewed as containing two parts: a trough or valley 455, and a chute or barrier 460. In the embodiment shown, the bottom 465 of the trough 455 is an extension of the chute 460. Trough 455 has an open top.

In operation, debris and sand will flow in a generally horizontal direction into the chute 460, as indicated by arrow 470. Fluidized sand will flow through the holes in the chute 460, but the large debris particles will not. The particles will cross over the open top of the trough 455 and collide with the chute 460. When the section 450 is removed from the fluidized bed 12 in FIG. 1, the debris will tumble into the trough 455, if it has not already done so. Sand will fall though the holes in both the chute 460 and the bottom 465 of the trough 455.

Figure 27:
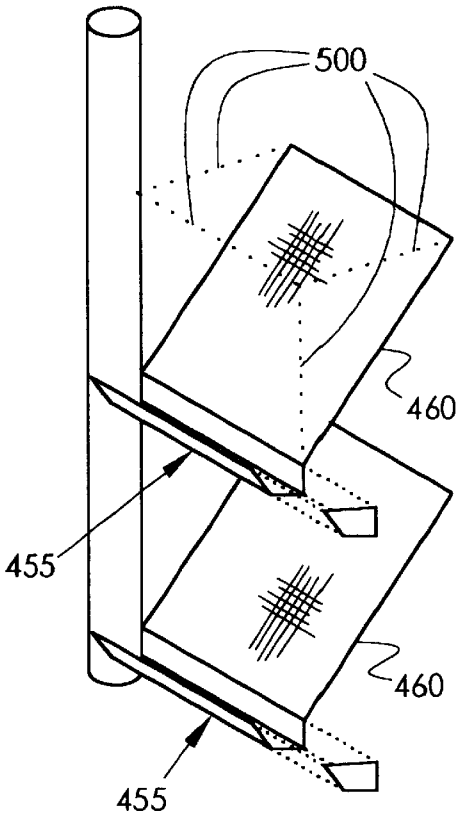
Figure 26:
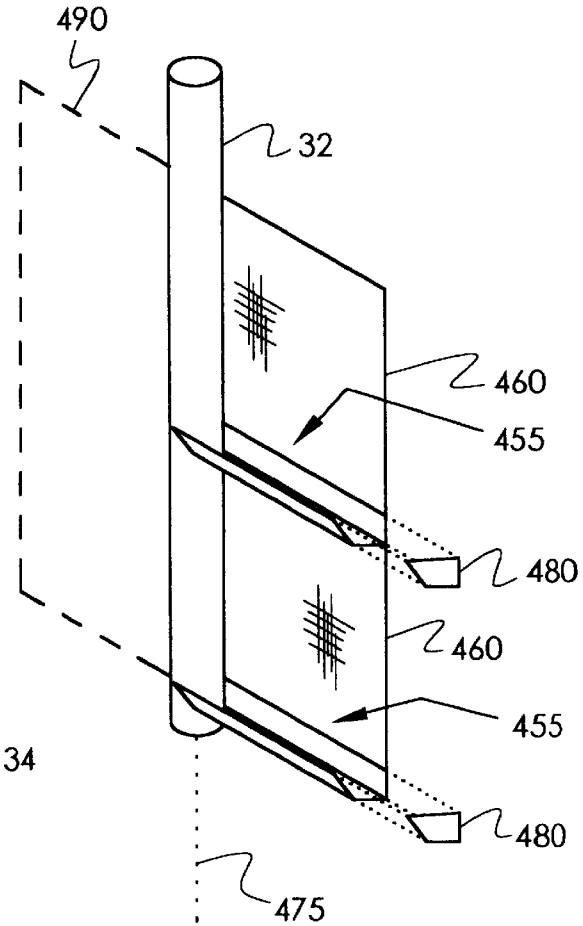

FIGS. 26 and 27 illustrate other approaches. In FIG. 26, the chutes 460 are flat, and are co-planar with the axis 475 of shaft 32. The troughs 455 lie one-above-the-other, in a stack. End caps 480 are shown removed to illustrate the troughs 455. Dashed block 490 indicates that a mirror-image structure, containing troughs 455, chutes 460, and end caps 480, can be fabricated 180 degrees opposite the structure shown, on the shaft 32, or at other positions on shaft 32.

FIG. 27 illustrates another embodiment. Chutes 460 are inclined, as is chute 460 in FIG. 28. However, the troughs 455 are stacked one-above-the-other, as in FIG. 26. Walls indicated by dashed lines 500 may be provided, to assist in capture of debris. Such walls can be provided for both chutes 460.

Figure 25:
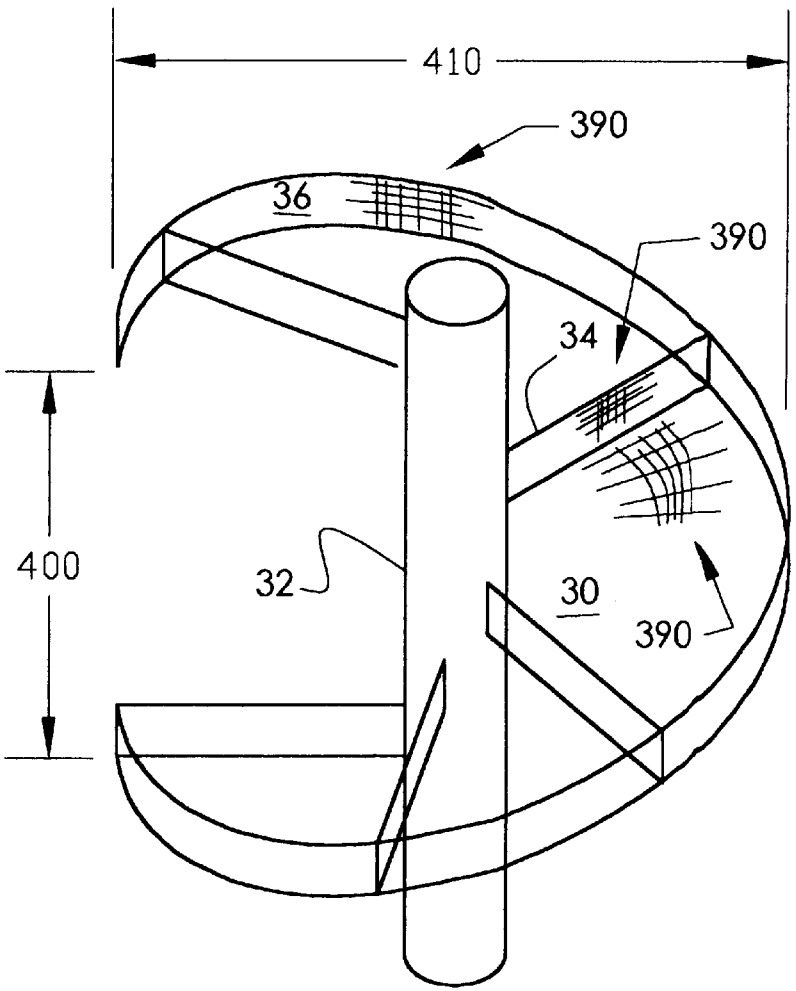
FIGS. 24, 25, 26, and 27 illustrate additional forms of the invention.

In one form of the invention, the pitch of the helix, namely, dimension 400 in FIG. 25, is about 12 inches. Diameter, dimension 410, is about 16 inches. Diameter of shaft 32, dimension 415, is about one inch. The holes in the screen are rectangular, at 0.187×0.187 inches. The holes could be circular, and of the same area as the rectangular holes just identified.

Figure 1:
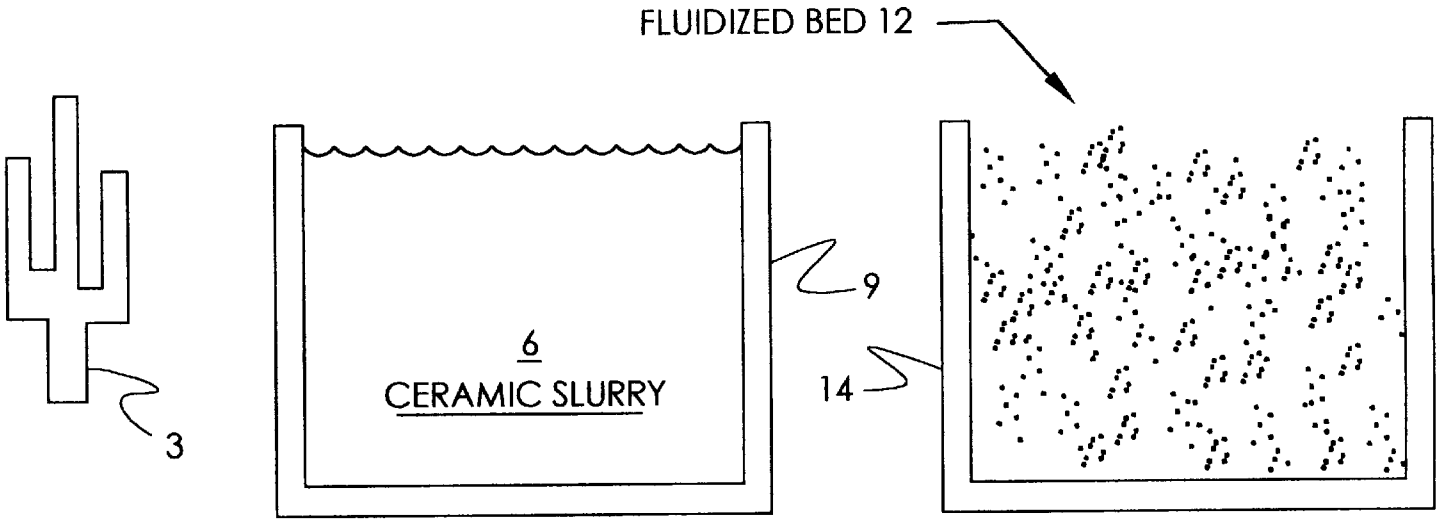
FIG 1 PRIOR ART
FIGS. 1 and 2 illustrate a problem which occurs in the prior art. Item 3 is a wax prototype, item 6 is a ceramic slurry, and item 12 is a fluidized bed of sand.
Figure 2:
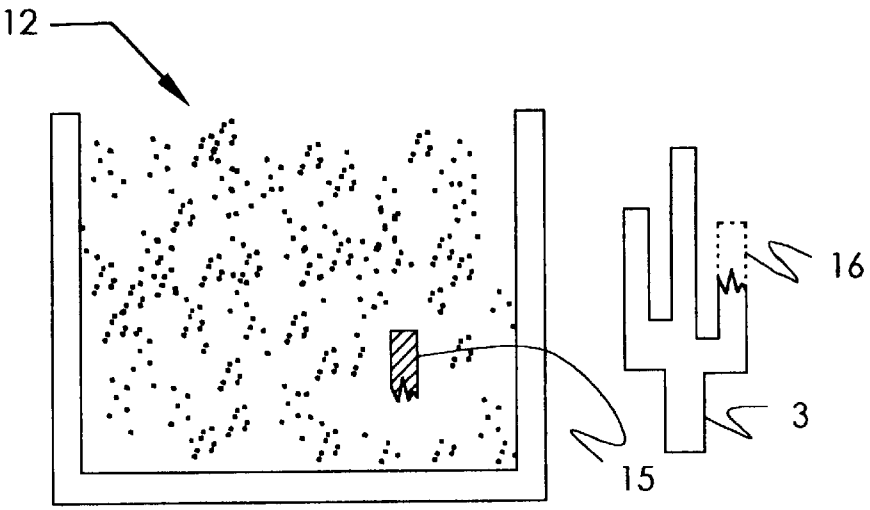
FIG 2 PRIOR ART

Tank 14 in FIG. 1 was described as containing a fluidized bed 12 of sand particles. There is preferably no liquid in the tank. The sand acquires fluid-like properties by the action of moving gas. Fluidized beds are known in the art.

Figure 29:
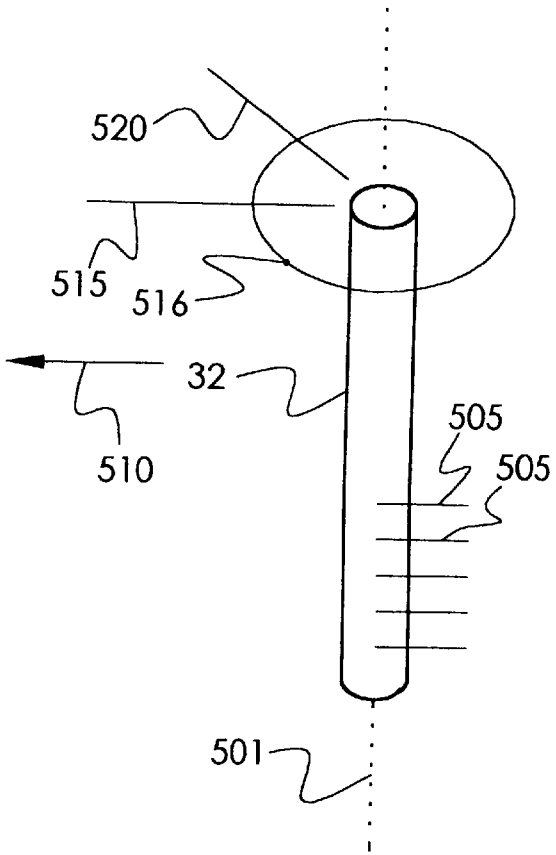
FIG. 29 illustrates shaft 32 of FIG. 5, and a coordinate system superimposed thereon.

FIG. 29 illustrates shaft 32, and a coordinate system superimposed thereon. Axis 501 represents the axial direction. Lines 505 are positioned at different axial positions. Thus, the different walls 34 in FIG. 5 can be said to lie at different axial positions. The same statement applies to the troughs of 455 of FIGS. 26 and 27.

In FIG. 29, arrow 510 represents a radial direction, or a direction along a radius. Thus, troughs of FIGS. 26 and 27 can be said to extend radially from the shaft 32.

In FIG. 29, lines 515 and 520, which are radial lines, represent different angular positions with respect to a reference point, such as point 516. Thus, troughs 455 in FIG. 27 occupy different angular positions.

Applying the preceding conventions, one sees that the walls 34 in FIG. 5 (1) extend radially, (2) occupy different axial positions, and (3) occupy different angular positions. Further applying the preceding conventions, one sees that the troughs 455 in FIG. 26 occupy different axial positions, but the same angular position.

Numerous substitutions and modifications can be undertaken without departing from the true spirit and scope of the invention. What is desired to be secured by Letters Patent is the invention as defined in the following claims.

What is claimed is:

1. A system comprising:

a) a tank containing fluidized solid particles having debris therein but no liquid;

b) a perforated cage to capture the debris;

c) means for moving the cage to selected portions within the tank to capture the debris, without involvement of muscle power to lift the cage.

2. System according to claim 1 wherein the cage comprises an inclined deck to extract the debris and containing perforations.

3. System according to claim 2, wherein the deck comprises a woven screen, and the woven screen contains the perforations.

4. System according to claim 3 wherein the woven screen is a helical screen.

5. System according to claim 1 wherein the cage further comprises barriers standing upwardly from the deck to catch the debris.

* * * * *